US006553953B1

(12) United States Patent
Fujihara et al.

(10) Patent No.: US 6,553,953 B1
(45) Date of Patent: Apr. 29, 2003

(54) SUCTION DUCT

(75) Inventors: Kazuo Fujihara; Yasuo Sakakibara; Yoshikazu Hirose; Takahiro Komori; Hitoshi Kino; Zenichi Yasuda; Hidetoshi Ishihara; Kuniyasu Ito; Masaru Hattori, all of Nishikasugai-gun (JP)

(73) Assignee: Toyoda Gosei Co., Ltd., Aichi-ken (JP)

( * ) Notice: Subject to any disclaimer, the term of this patent is extended or adjusted under 35 U.S.C. 154(b) by 0 days.

(21) Appl. No.: 09/647,975

(22) PCT Filed: Mar. 25, 1999

(86) PCT No.: PCT/JP99/01535

§ 371 (c)(1),
(2), (4) Date: Nov. 29, 2000

(87) PCT Pub. No.: WO99/53188

PCT Pub. Date: Oct. 21, 1999

(30) Foreign Application Priority Data

| | | |
|---|---|---|
| Apr. 9, 1998 | (JP) | 10-097585 |
| Jun. 2, 1998 | (JP) | 10-153133 |
| Jun. 16, 1998 | (JP) | 10-168893 |

(51) Int. Cl.[7] ..... F02M 35/10

(52) U.S. Cl. ..... 123/184.21; 123/184.61; 181/214

(58) Field of Search ..... 123/184.21, 184.53, 123/184.57, 184.61; 181/214, 229

(56) References Cited

U.S. PATENT DOCUMENTS 5,571,242 A * 11/1996 Demorest ..... 123/184.21

FOREIGN PATENT DOCUMENTS

| | | |
|---|---|---|
| JP | 63-38615 | 3/1988 |
| JP | 63-285257 | 11/1988 |
| JP | 1-102467 | 7/1989 |
| JP | 4-97838 | 8/1992 |
| JP | 5-38352 | 5/1993 |
| JP | 8-68365 | 3/1996 |
| JP | 8-100672 | 4/1996 |
| JP | 8-152888 | 6/1996 |
| JP | 8-188947 | 7/1996 |
| JP | 8-243334 | 9/1996 |
| JP | 8-300533 | 11/1996 |
| JP | 8-338330 | 12/1996 |

* cited by examiner

*Primary Examiner*—Tony M. Argenbright
*Assistant Examiner*—Katrina B. Harris
(74) *Attorney, Agent, or Firm*—Posz & Bethards, PLC

(57) ABSTRACT

At least a part of a duct wall of a suction duct is formed out of a molded body of non-woven fabric. The non-woven fabric contains a thermoplastic resin binder.

29 Claims, 14 Drawing Sheets

SUCTION DUCT

This application is the national phase of International Application PCT/JP99/01535 filed Mar. 25, 1999 which designated the U.S.

TECHNICAL FIELD

The present invention relates to a suction duct as a passageway for supplying the air to an engine, and particularly relates to a suction duct in which noise at the time of sucking the air is lowered.

BACKGROUND ART

In a suction system of a motorcar engine, there is a defect that noise is generated in an air cleaner hose, a suction duct, or the like, when the air is sucked. This suction noise is harsh particularly at a low engine speed. Therefore, a side branch 201 and/or a resonator 202 is hitherto provided in a suction duct 200 as shown in FIG. 25, so as to reduce noise at a specific frequency calculated on the basis of Helmholtz resonance theory and so on.

The side branch 201 is, however, about 30 cm long if it is the longest, and the resonator 202 has a volume of 14 liters if it is the largest. Thus, the space in an engine room occupied by such noise absorption equipment increases and results in a defect that the degree of freedom to mount other parts is lowered.

Therefore, JP-U-64-22866 discloses a method in which an orifice is disposed in a suction duct, and suction noise is reduced by reducing the suction. By narrowing a suction passageway thus, acoustic mass increases so that suction noise in a low tone range can be reduced.

In addition, JP-U-3-43576 discloses a suction noise reduction apparatus which comprises two suction ducts connected in parallel to an air cleaner case, branch ducts branching from the two suction ducts respectively, and a common resonator to which all the branch ducts are coupled. The suction noise reduction apparatus further comprises an on-off valve which selectively opens in accordance with the driving condition and which is provided on the upstream side of a branch duct connecting portion in one of the suction ducts.

According to the apparatus disclosed in this publication JP-U-3-43576, the on-off valve is controlled in accordance with an engine speed so that the number of suction ducts is switched to one or two. Thus, the quantity of sucked air can be controlled in accordance with the engine speed, and suction noise can be reduced.

In the above-mentioned method in which the suction passageway is narrowed, however, there is a defect that the quantity of sucked air is insufficient at a high engine speed so that the output is lowered.

In addition, in the apparatus disclosed in this publication JP-U-3-43576, an electronic control circuit, an electromagnetic on-off valve, a diaphragm actuator, or the like, is used for driving the on-off valve. Those are not preferable in terms of the cost. In addition, since an electronic control circuit, an electromagnetic on-off valve, or the like, is necessary, the apparatus becomes not only complicated and expensive but also large in the number of man-hour for maintenance.

DISCLOSURE OF THE INVENTION

The present invention was developed in the light of such circumstances. It is an object of the present invention to provide a suction duct in which without narrowing a suction passageway and without using any electronic control circuit, any electromagnetic on-off valve, or the like, suction noise at a low engine speed can be lowered with a simple and low-priced configuration, and a sufficient quantity of the air can be supplied at a high engine speed.

A suction duct according to the present invention is characterized in that at least a part of a duct wall is formed out of a molded body of non-woven fabric in a suction duct disposed between an outside air intake of a motorcar and an intake manifold of an engine.

PET (polyethylene terephthalate) fibers, PP (polypropylene) fibers, PE (polyethylene) fibers, etc. can be used as fibers constituting this non-woven fabric. In view of fiber variation, quality, price, and so on, however, it is preferable that PET fibers are used.

In addition, it is preferable that the permeability per $1m^2$ of the molded body in the case of air with a pressure difference of 98 Pa is not larger than 6,000 $m^3/h$ in the above-mentioned suction duct. That is, "permeability" herein means the quantity of the air passing through a test specimen in terms of unit area and unit time when the pressure difference between two chambers sectioned by the test specimen is set to be 98 Pa.

The above-mentioned suction duct is preferably configured so that the whole of the duct wall is formed out of the molded body, the non-woven fabric contains high-melting fibers of high-melting thermoplastic resin and low-melting fibers of low-melting themoplastic resin having a lower melting point than that of the high-melting fibers, and the ratio of the low-melting fibers to the non-woven fabric is higher than that of the high-melting fibers.

In the case where the suction duct is molded by compression molding, "low-melting" herein means that a melting point is lower than the temperature in the compression molding, while "high-melting" means a melting point is higher than the temperature in the compression molding.

In addition, the suction duct may be configured so that the whole of the duct wall is formed out of the molded body, the non-woven fabric contains thermoplastic fibers constituted by a core material consisting of high-melting thermoplastic resin and a coating layer applied onto the surface of the core material and consisting of low-melting thermoplastic resin having a lower melting point than that of the core material, and the volume of the coating layer is larger than that of the core material.

The molded body of the above-mentioned suction duct may be formed out of non-woven fabric having a functional layer to which a predetermined function is given. Preferably, this functional layer is a water-repellent layer.

Further, according to the present invention, there is formed a suction duct which comprises a first segment having a substantially semicircular sectional shape and constituted by a molded body made of synthetic resin and a second segment having a substantially semicircular sectional shape and constituted by a molded body made of non-woven fabric, and in which the first and second segments are coupled integrally with each other.

The present inventors made researches earnestly on the relationship between the material of a suction duct and the noise generated therefrom. As a result, it was found out that, when a duct wall was formed out of permeable material having predetermined permeability, it was difficult to generate a standing wave so that suction noise was reduced conspicuously. The present invention was developed on the basis of such a discovery.

Noise generated at the time of air suction is chiefly caused by an acoustic standing wave generated inside a suction duct. The frequency of the standing wave depends on the length, diameter and material of the suction duct, and so on. Therefore, according to the present invention, at least a part of a duct wall of a suction duct is formed out of a molded body of non-woven fabric.

The reason why suction noise is reduced by forming a duct wall out of a non-woven fabric molded body is unknown in detail. However, the following three reasons are considered.

(i) Since non-woven fabric is an elastic body, it has a vibration damping effect, so that an acoustic wave is restrained from being generated by the vibration of the duct wall.

(ii) The energy of an acoustic wave entering a large number of gaps among fibers of the non-woven fabric is weakened by the effect of the viscosity and heat conduction of the gaps. In addition, the fibers themselves resonate with the fluctuation of the sound pressure so that the sound energy attenuates.

(iii) Since at least a part of the duct wall has a certain measure of permeability, an acoustic wave partially passes through the duct wall so that a standing wave is restrained from being generated.

It is considered that suction noise is reduced by the synergistic effect of these reasons.

However, when the permeability of the non-woven fabric molded body is too high, there is a defect that an acoustic wave inside the suction duct penetrates the duct wall and leaks to the outside so that noise increases. It is therefore preferable that the air permeability per 1 $m^2$ to the air with a pressure difference of 98 Pa is not larger than 6,000 $m^3$/h. The limitation that the air permeability is not larger than 6,000 $m^3$/h per unit area is, of course, for the case of the air with a pressure difference of 98 Pa. It is a mater of course that the limitation value of the permeability is different if the suction pressure is different.

If the permeability per 1 $m^2$ of the non-woven fabric molded body exceeds 6,000 $m^3$/h, an acoustic wave passing through the duct wall of the suction duct increases so that penetrating noise increases. On the contrary, if the permeability is zero, noise is lower than in a background-art suction duct though the effect of restraining noise in a low frequency band of not higher than 200 Hz is lowered. To make the non-woven fabric molded body have zero permeability, it will go well if a surface skin layer like a film is formed on the external surface of the non-woven fabric molded body. Although the permeability can be made zero even if a surface skin layer is formed on the internal surface, this way is not preferable because it becomes difficult to reduce noise for the above-mentioned reason (ii). Incidentally, it is preferable that the permeability per 1 $m^2$ of the non-woven fabric molded body to the air with a pressure difference of 98 Pa is larger than zero and smaller than 4,200 $m^3$/h, and particularly larger than 0 and smaller than 3,000 $m^3$/h.

At least a part of the suction duct according to the present invention has a molded body consisting of non-woven fabric. It is preferable that this non-woven fabric is formed out of thermoplastic fibers. If non-woven fabric made of thermoplastic resin fibers is used, even a suction duct having a complicated shape can be easily shaped and molded by hot press molding (heating compression molding) or the like. In this case, thermoplastic resin fibers may constitute a part of the non-woven fabric, or the whole of the non-woven fabric may be formed out of thermoplastic resin fibers. Alternatively, even non-woven fabric in which non-thermoplastic fibers are impregnated with a thermoplastic resin binder can be shaped by hot press molding or the like in the same manner as non-woven fabric formed out of thermoplastic resin fibers. Thus, suction noise can be reduced in the same manner as described above.

Indeed, the molded body consisting of non-woven fabric has a certain measure of effect on reduction in suction noise if the molded body exists in at least a part of the duct wall of the suction duct. But, a standing wave is generated easily with increase of a portion formed out of non-permeable material other than non-woven fabric. It is therefore preferable that the whole of the suction duct is formed out of a molded body of non-woven fabric.

However, in the case where the whole of the suction duct is formed out of a molded body of non-woven fabric, there is a case where a defect such as a crack or the like is generated in the wall surface so that suction noise leaks when the suction duct is to be formed to have a deep draw portion or a bent portion with a small curvature radius by hot press molding. In order to prevent such a defect, there can be considered a method in which the molded body is complicatedly divided into segments, and the segments are bonded into a predetermined shape. In this case, however, there is a defect that the number of man-hour increases so that the productivity deteriorates and the cost increases.

It is therefore preferable that the whole of the duct wall is formed out of a molded body, and the non-woven fabric is configured so as to contain high-melting fibers and low-melting fibers having a lower melting point than that of the high-melting fibers, while the ratio of the low-melting fibers to the non-woven fabric is higher than that of the high-melting fibers.

If the thus configured non-woven fabric is subjected to hot press molding, the low-melting fibers are softened and melted preferentially, while the high-melting fibers are deformed plastically or elastically. Finally, the softened low-melting fibers are cooled and solidified so that the non-woven fabric is formed into a predetermined shape. Thus, the degree of freedom for the fibers to move at the time of molding is so large that the non-woven fabric can be easily formed into a shape which has a deep draw portion or a bent portion with a small curvature radius. Even if a crack is generated on the wall surface, the crack is filled with the molten low-melting fibers existing plentifully so as to be welded and bonded. Thus, the above-mentioned defect is prevented.

It will go well so long as the volume of the low-melting fibers is larger than that of the high-melting fibers and it is preferable that the ratio of the low-melting fibers to the non-woven fabric is in a range of from 20% to 50%. If the ratio is smaller than 20%, the above-mentioned effect is difficult to appear. On the contrary, if the ratio is larger than 50%, the molded body is insufficient in heat resistance. Incidentally, it is preferable that the melting point of the low-melting fibers is in a range of from 150° C. to 170° C. and the melting point of the high-melting fibers is in a range of from 220° C. to 260°C.

The non-woven fabric may contain other fibers than the high-melting fibers and the low-melting fibers. Although such other fibers are not limited specifically, it is also preferable that fibers having a special function, such as water-repellent fibers or the like, is used.

Further, it is also preferable that the non-woven fabric is configured to contain thermoplastic fibers constituted by a core material consisting of high-melting thermoplastic resin and a coating layer applied onto the surface of the core material and consisting of low-melting thermoplastic resin having a lower melting point than that of the core material, and the volume of the coating layer is larger than that of the core material.

With the non-woven fabric configured thus, the coating layer is softened and melted preferentially at the time of hot press molding, while the core material is deformed plastically or elastically. Finally, the softened coating layer is cooled and solidified so that the non-woven fabric is formed into a predetermined shape. Thus, the degree of freedom for the fibers to move at the time of molding is so large that the non-woven fabric can be easily formed into a shape which has a deep draw portion or a bent portion with a small curvature radius. Even if a crack is generated on the wall surface, the crack is filled with the molten coating layer existing plentifully so as to be welded and bonded. Thus, the above-mentioned defect is prevented.

It will go well so long as the volume of the coating layer is larger than the volume of the core material, and it is preferable that the ratio of the thermoplastic fibers to the non-woven fabric is in a range of from 20% to 50%. If the ratio is smaller than 20%, the above-mentioned effect is difficult to appear. On the contrary, if the ratio is larger than 50%, the molded body is insufficient in heat resistance. Incidentally, it is preferable that the melting point of the coating layer is in a range of from 150° C. to 170° C. and the melting point of the core material is in a range of from 220° C. to 260° C.

In the case where non-woven fabric partially containing thermoplastic fibers with such a double-layer structure is used, it is preferable to use non-woven fabric containing at least 20 to 50 volume % of such thermoplastic fibers. If the content of the thermoplastic fibers is smaller than 20 volume %, the above-mentioned effect is not exhibited well so that a crack may remain in the molded body.

In the suction duct according to the present invention, the thickness or characteristic of the molded body may change due to aged deterioration, moisture penetration, or the like. As a result, the balance between penetrating noise passed through the molded body and suction noise radiated from a suction inlet at a front end of the suction duct may be lost so that the performance of restraining the suction noise may change.

It is therefore preferable that the molded body is formed out of non-woven fabric having a functional layer to which a predetermined function is given. A water-repellent layer, a clogging preventing layer, etc. are exemplified as such a functional layer. Such a molded body can be formed easily by using non-woven. fabric in which fibers having their own functions are mixed in their suitable portions. Alternatively, films having their own functions may be laminated on non-woven fabric in use.

The above-mentioned "clogging preventing layer" herein means a film like cover which covers the external surface of the suction duct consisting of non-woven fabric so that a free space having an enough size not to prevent the airs in the suction duct from passing through the duct wall consisting of the non-woven fabric is provided between the external surface of the suction duct and the cover (see FIGS. 26A and 26B). The cover is fixed to the external surface of the suction duct by a tape or the like.

The position of this function layer can be set desirably in the thickness direction of the molded body. For example, in the case where a water-repellent layer is used, it is preferable that the water-repellent layer is provided on a surface layer or an intermediate layer of the molded body. Thus, moisture is prevented from invading the molded body. As a result, the characteristic of the molded body is prevented from changing so that the effect of reducing suction noise can be kept for a long time. In addition, water is restrained from invading an air cleaner so that it is possible to restrain engine trouble caused by the loss of the permeability of air. cleaner elements.

Incidentally, in the case where a cylindrical body such as a suction duct is manufactured by compression molding, it is usual that a plurality of segments, such as first and second segments each having a substantially semicircular sectional shape, are formed by compression molding, and then the segments are bonded integrally with each other. In addition, in order to increase the bonding strength of the segments, generally, flange portions are formed in each segment on its opposite sides, and those flange portions of the segments are bonded with each other so that the bonding area increases. Also in the case where the suction duct is formed out of non-woven fabric, it is preferable that a similar method is adopted, and the flange portions on opposite sides of the segments are bonded integrally with each other.

However, in the suction duct manufactured in such a method, the portion where the flange portions are bonded with each other becomes about twice as thick as any other ordinary portion, so that the rigidity increases. As a result, it is considered that it is difficult to absorb vibration when the suction duct is in use so that there arises a defect in durability or in vibration noise.

In addition, any portion other than the flange portions is insufficient in rigidity so that the shape retentivity is low. As a result, there is a defect that such a portion buckles up when large negative pressure or external force acts thereon, or the positioning accuracy is low when the suction duct is. attached to a partner member.

Taking such circumstances into consideration, it is preferable to manufacture a suction duct which has a hard portion with high compressibility and a soft portion with low compressibility, and which is formed out of non-woven fabric containing a thermoplastic resin binder by compression molding.

Moreover, in the above-mentioned suction duct, it is preferable that the hard portion extends linearly.

Further, in the above-mentioned suction duct, an engagement portion which can engage with a partner member may be formed in the hard portion.

Then, in the suction duct according to the present invention, a plurality of segments are formed out of non-woven fabric containing a thermoplastic resin binder by compression molding so that each of the segments has a substantially semicircular sectional shape with flange portions on its opposite sides respectively. The flange portions of the segments are bonded with each other so that the segments are formed into a cylinder, and a deformable flexible portion is provided in at least a part of the flange portions.

The non-woven fabric used for the above-mentioned suction duct contains a thermoplastic resin binder. That is, it is possible to use non-woven fabric in which non-thermoplastic fibers are impregnated with a thermoplastic resin binder, non-woven fabric which contains thermoplastic resin fibers as a binder, or the like of them, the non-woven fabric which contains thermoplastic resin fibers is used preferably. If the non-woven fabric which contains thermoplastic resin fibers is used, even the suction duct having a complicated shape can be shaped and molded easily. In this case, the thermoplastic resin fibers may constitute a part of the non-woven fabric, or the whole of the non-woven fabric may be formed out of the thermoplastic resin fibers. In the case where the whole of the suction duct is formed out of a molded body of non-woven fabric, it is preferable that the flange portions on the opposite sides of the segments are bonded integrally with each other. However, the portion where the flange portions are bonded with each other about twice as thick as any other ordinary portion, so that the rigidity increases. As a result, there arises a defect as mentioned above.

Therefore, the suction duct according to the present invention has a hard portion with high compressibility and a soft portion with low compressibility. With such a configuration, the soft portion is rich in flexibility enough to be deformed easily and to follow external force easily. It is therefore possible for the soft portion to absorb vibration when the suction duct is in use, so that the durability is improved and noise due to vibration can be restrained from being generated. In addition, various properties can be given to the suction duct by selecting the positions or sizes of the soft and hard portions.

Incidentally, there is no specific limitation so long as there is a slight difference in compressibility between the soft portion and the hard portion. The difference in compressibility may be set desirably in accordance with applications, use conditions, and so on.

It is also preferable that the hard portion is configured to extend linearly. Thus, the hard portion acts like a reinforcing rib, so that the shape retentivity is enhanced. For example, if the hard portion is formed in the circumferential direction of the suction duct, the suction duct is prevented from buckling even if excessive negative pressure or external force acts on the suction duct. Further, if the hard portion is formed in the direction in which the suction duct extends, the shape retentivity is enhanced so that the accuracy in attaching the suction duct to a partner member is enhanced.

It is also preferable that the hard portion is formed to have an engagement portion which can engage with a partner member. As the engagement portion, engagement claws, attachment flanges, etc. are exemplified. If such an engagement portion is thus formed in the hard portion, other parts become unnecessary. As a result, the number of parts is reduced so that the number of man-hour can be reduced, and the cost can be reduced. In addition, separation in recycling becomes so easy that the recyclability is enhanced. Incidentally, since the engagement portion is formed in the hard portion with high compressibility, the strength of the engagement portion can be ensured sufficiently. It is also preferable that only the compressibility of the engagement portion is made further higher.

Further, it is also preferable that at least a part of the flange portion is provided with a deformable flexible portion. When vibration occurs, the flexible portion is deformed to absorb the vibration, so that the durability is enhanced while noise due to the vibration can be restrained.

As the shape of this flexible portion, a corrugated shape in which mountain portions and valley portions are alternated continuously is representatively exemplified. Incidentally, it is also preferable that a flexible portion is provided not only in the flange portion but also in a cylindrical ordinary portion. As a result, the suction duct is deformed more easily so that the vibration damping property is further enhanced.

Further, the suction duct may be constituted by first and second segments each having a substantially semicircular sectional shape, one of the segments being formed out of a resin molded body, the other being formed out of a non-woven fabric molded body. Since the first segment formed out of a resin molded body has large rigidity, so that a bracket portion or a fitting portion for fixing the suction duct to an air cleaner can be formed integrally with the first segment. Thus, the number of parts is reduced so that the productivity is enhanced. In addition, the assembling property and reliability are also improved.

The first and second segments may be coupled integrally with each other through a clip or the like prepared separately. In this case, however, there is a defect that the number of parts increases. It is therefore preferable that the first and second segments are coupled by themselves. For example, there is a method in which the first and second segments are coupled mechanically through an engagement means such as engagement claws formed in the first segment; a method in which the first and second segments are coupled by welding; and so on. The first segment has enough strength because it is made of resin, so that the engagement means such as engagement claws can be formed integrally with the first segment.

BRIEF DESCRIPTION OF THE DRAWINGS

FIG. 26A is a sectional view taken in a direction perpendicular to the lengthwise direction of a suction duct; and FIG. 26B is a side view of the suction duct in which only a cover is illustrated by sectional view.

THE BEST MODE FOR CARRYING OUT THE INVENTION

Test Example

Figure 1:
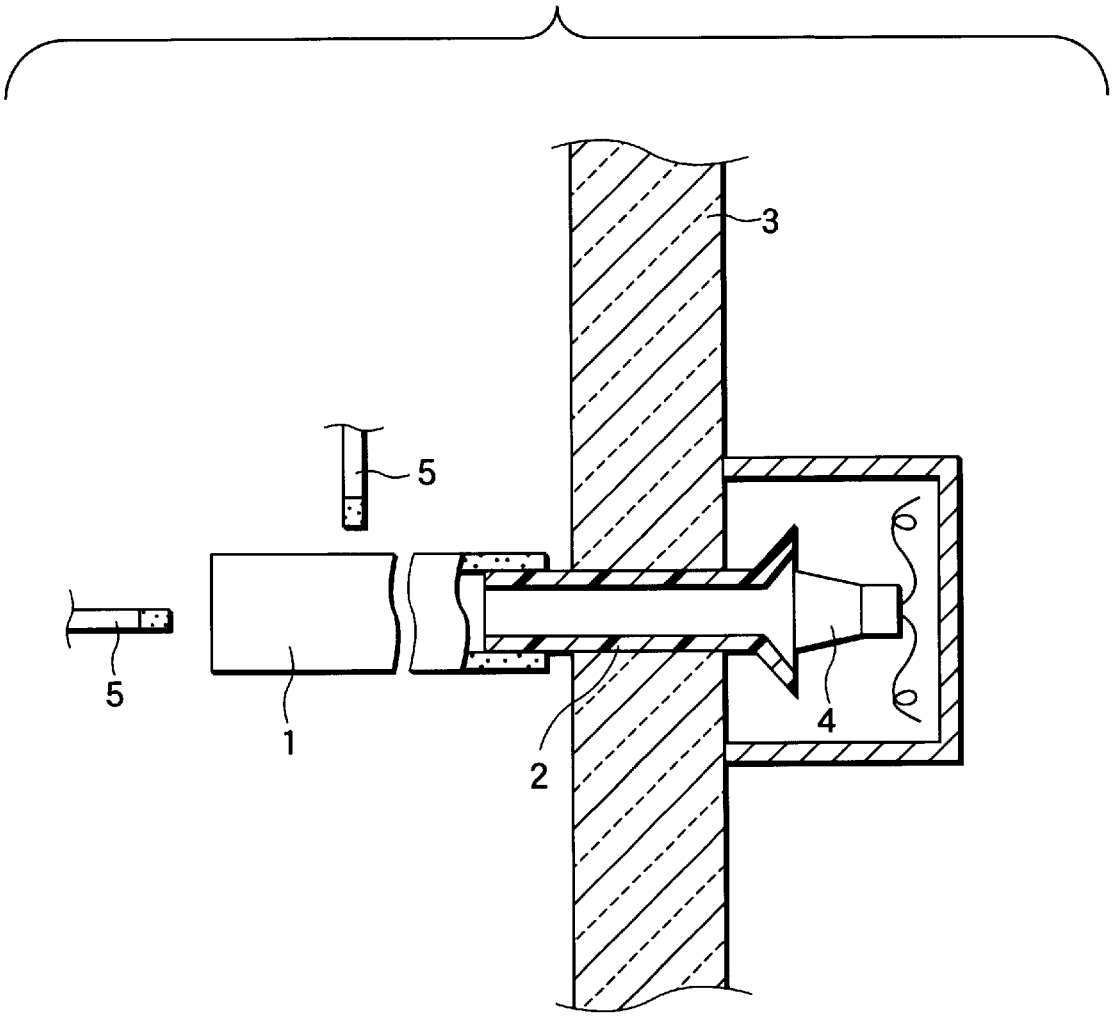
FIG. 1 is an explanatory view of the configuration of an apparatus used for measuring the frequency characteristic in Test Example according to the present invention.

The sound absorbing characteristics of ducts of various materials were examined with a test apparatus shown in FIG. 1. As the materials, the following three materials were used and formed into straight ducts each having an inner diameter of 60 mm and a length of 400 mm, so as to be served as specimens.

Specimen A: acrylic resin

Specimen B: PET (polyethylene terephthalate) fiber non-woven fabric (unit weight: 700 g/m$^2$, thickness: 1.5 mm, and permeability: 3,500 m$^3$/h·m$^2$)

Specimen C: two sheets of the PET fiber non-woven fabric of the specimen B piled up on each other (permeability: 1,750 m$^3$/h·m$^2$)

In this test apparatus, one end of a specimen 1 was connected to one end of an acrylic resin pipe 2 (inner diameter: 66 mm) penetrating a sound insulating wall 3, while the specimen 1 was entirely disposed in a sound-proof chamber. A speaker 4 was disposed at the other end of the pipe 2. Microphones 5 were disposed in a position 10 mm away from an opening at the other end of the specimen 1, and in a position 100 mm away from a duct wall of the specimen 1, respectively.

Then, white noise was generated from the speaker 4, and the frequency characteristics (frequency to sound pressure) of outlet sound produced from the opening of the specimen 1 and penetrating sound penetrating the duct wall of the specimen 1 were measured through the microphones 5, respectively. The results are shown in FIGS. 2 and 3.

Figure 2:
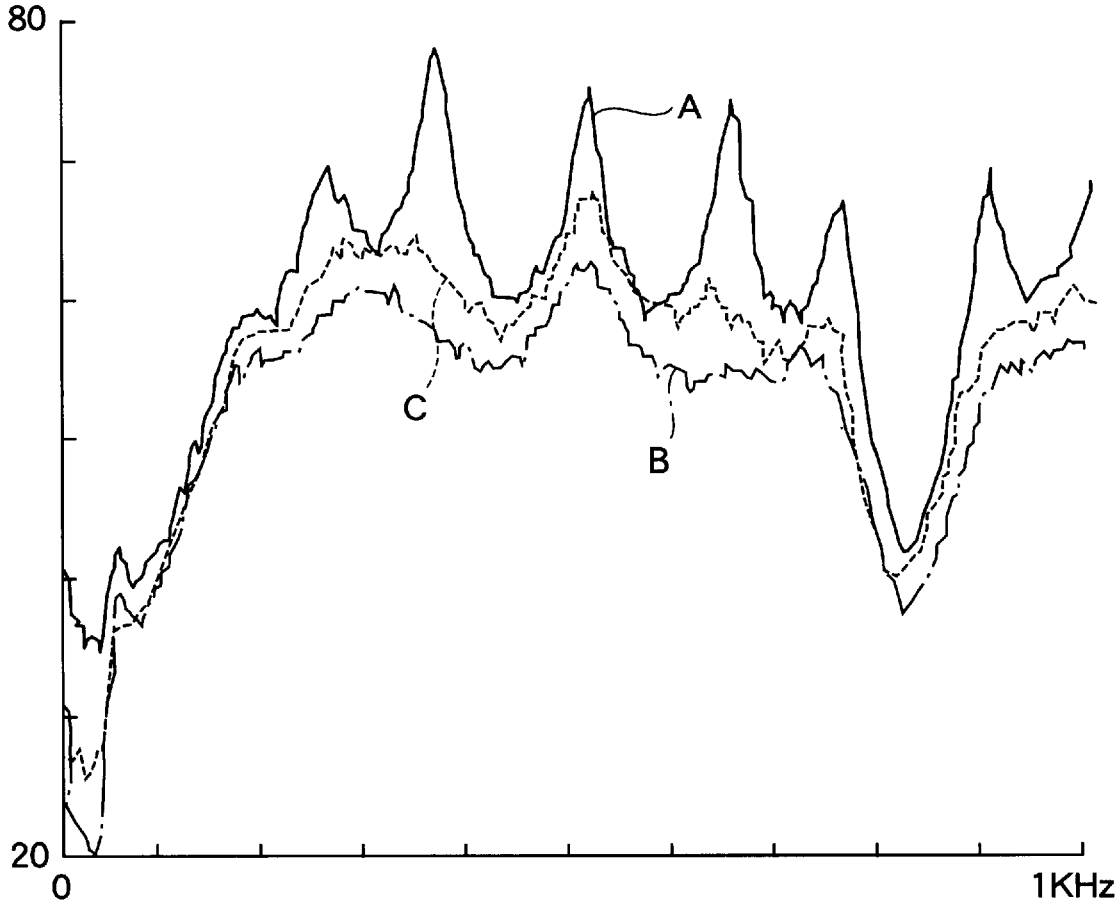
FIG. 2 is a graph showing the relationship between the frequency and the sound pressure of outlet sound in Test Example.
Figure 3:
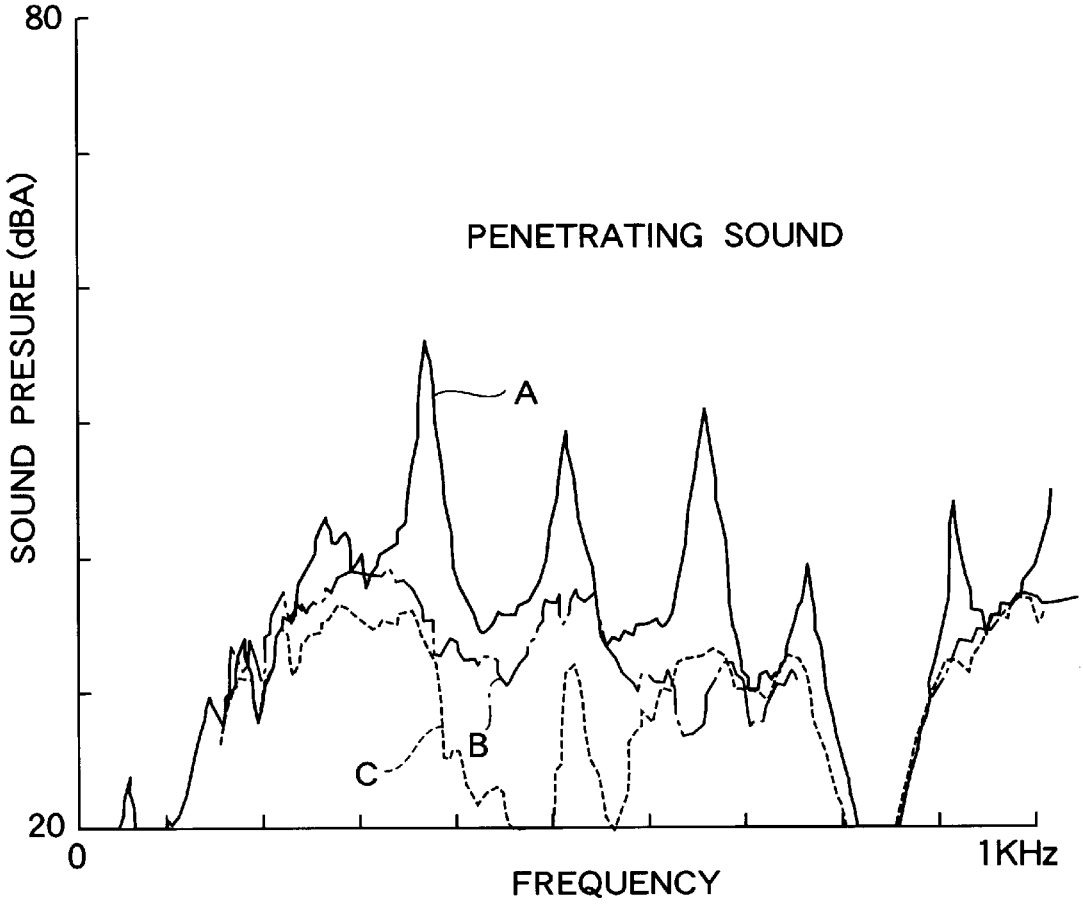
FIG. 3 is a graph showing the relationship between the frequency and the sound pressure of penetrating sound in Test Example.

It is understood from FIGS. 2 and 3 that the sound pressure of a standing wave is lower and generation of the standing wave is more restricted in the specimens B and C formed out of non-woven fabric than those in the specimen A formed out of acrylic resin. It is also understood that the sound pressure of a standing wave of the penetrating sound is lower in the specimen C than that in the specimen B though the sound pressure of a standing wave of the outlet sound is higher in the form than that in the latter. This is because the permeability per 1 m$^2$ in the specimen C is lower than that in the specimen B so that any sound wave is further restrained from penetrating the duct wall. It is therefore understood that the balance between the outlet sound and the penetrating sound can be adjusted by adjusting the permeability per 1 m$^2$.

Incidentally, though the permeability of the specimen A is zero, the penetrating sound is higher than that in the specimen B or C as shown in FIG. 3. This is because the microphone 5 by the side picks up the outlet pipe coming around.

EXAMPLE 1

Figure 4:
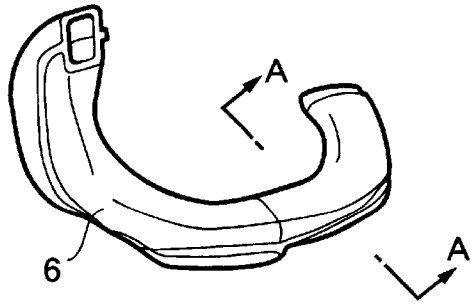
FIG. 4 is a perspective view of a suction duct according to Example 1.
Figure 5:
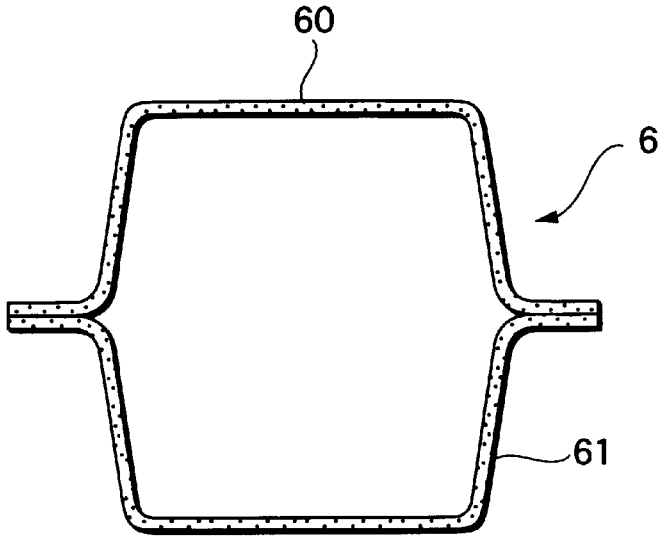
FIG. 5 is a sectional view of the suction duct according to Example 1.

FIG. 4 shows a perspective view of a suction duct 6 according to Example 1, and FIG. 5 shows a sectional view taken on line A—A thereof. In this suction duct 6, two segments which are divisions each having a portion of a small curvature radius are bonded integrally with each other. The segments are constituted by upper and lower members 60 and 61 which are shaped into split halves and welded with each other. The manufacturing method of this suction duct 6 will be described below in place of the detailed description of its configuration.

First, non-woven fabric which was formed out of PET fibers and which was about 35 mm thick was prepared. In this non-woven fabric, binder fibers consisting of low-melting PET fibers were contained by 30 volume %, and the unit weight was 700 g/m$^2$. Next, this non-woven fabric was disposed in a press molding mold, and hot-press-molded to be 3 mm thick while being heated to a melting point of the binder fibers. Thus, the upper and lower members 60 and 61 were formed.

Next, the upper and lower members 60 and 61 were fitted to each other like a duct, and the both were bonded integrally with each other by ultrasonic welding. Thus, the suction duct 6 (duct length: 700 mm, and inner diameter: 66 mm) according to Example 1 was obtained. The thicknesswise air permeability per 1 m$^2$ of the duct wall of this suction duct 6 was 3,900 m$^3$/h when the pressure difference was 98 Pa.

EXAMPLE 2

A kitchen wrap made of polyethylene was wrapped around the whole of the outer circumferential surface of the above-mentioned suction duct 6 according to Example 1 so as to be 10 $\mu$m thick. Thus, a suction duct according to Example 2 was obtained. The air permeability per 1 m$^2$ of the duct wall of this suction duct was zero when the pressure difference was 98 Pa.

Comparative Example 1

Figure 25:
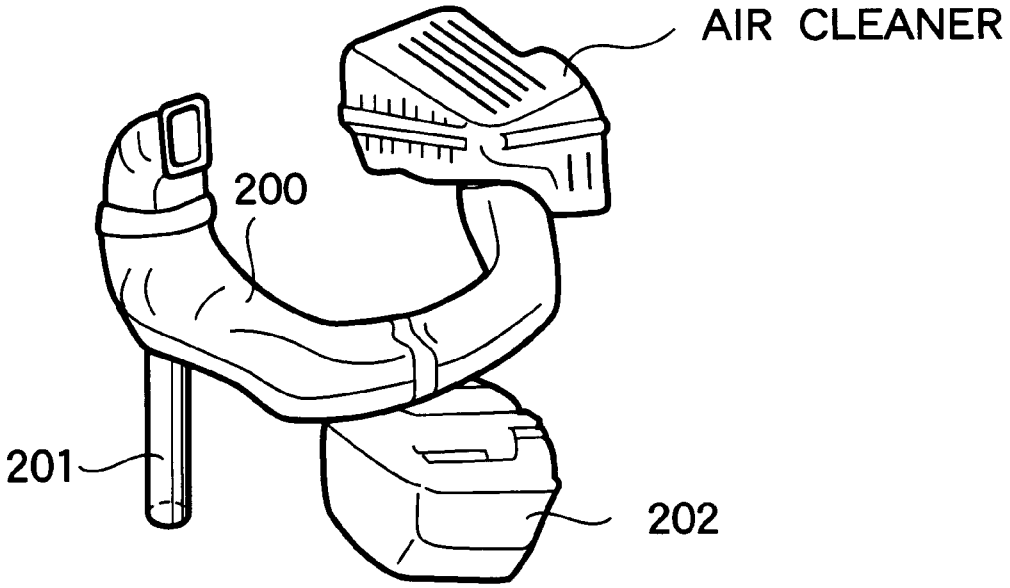
FIG.25 PRIOR ART
FIG. 25 is a perspective view showing the configuration of a background-art suction duct.
Figure 26A:
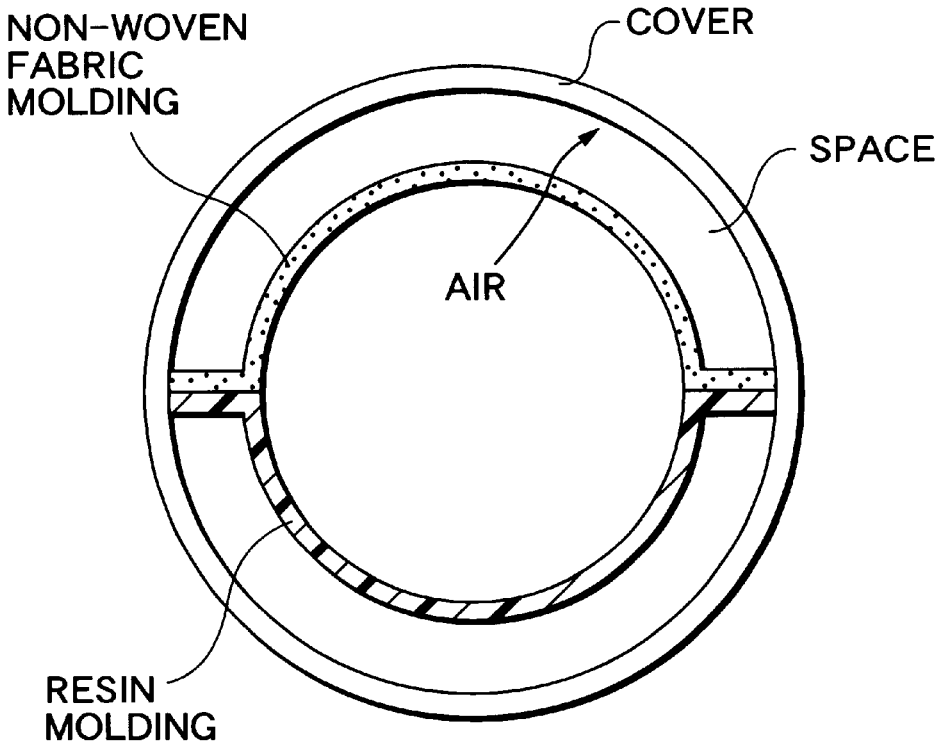
FIGS. 26A and 26B are an explanatory view of a clogging preventing layer.
Figure 26B:
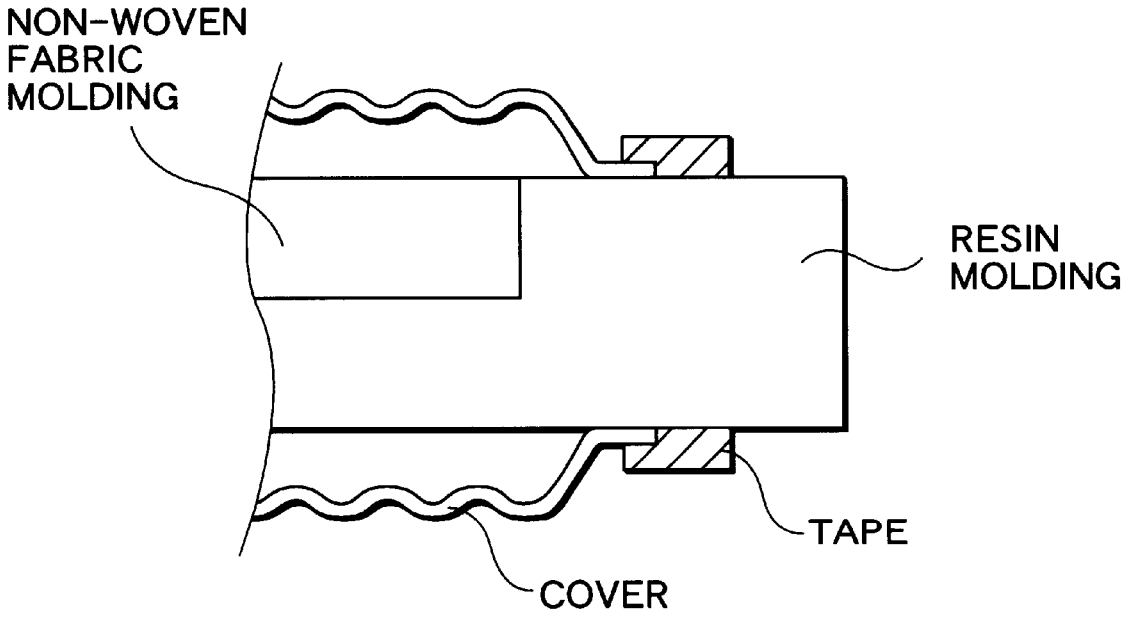

A background-art suction duct 200 shown in FIG. 25 was used as Comparative Example 1. This suction duct 200 was formed out of high density polyethylene by blow molding so as to be 700 mm in duct length and 66 mm in inner diameter. The thicknesswise air permeability of the duct wall was zero when the pressure difference was 98 Pa.

Test/Evaluation

Each of the above-mentioned suction ducts was disposed in the same test apparatus as in Test Example, and their frequency characteristics with respect to suction noise were measured in the same manner. Two kinds of suction noise, that is, outlet sound generated from the inlet of the suction duct and penetrating sound generated from the duct wall, were measured. The result of the outlet sound is shown in FIG. 6, and the result of the penetrating sound is shown in FIG. 7.

Figure 6:
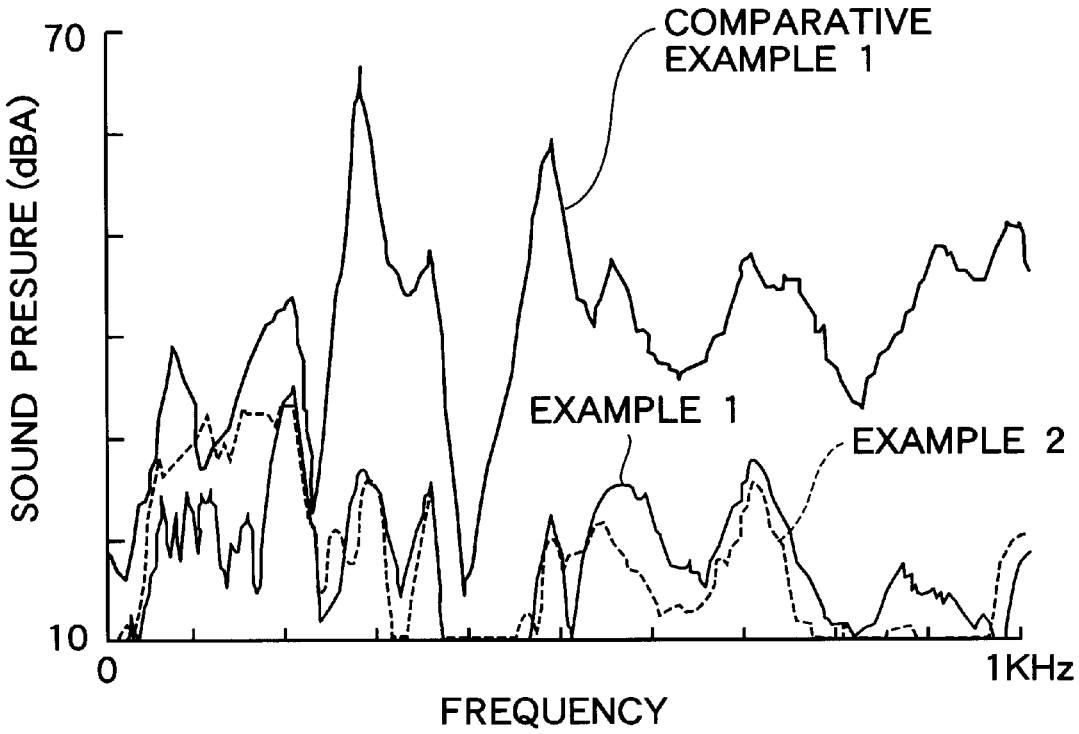
FIG. 6 is a graph showing the relationship between the frequency and the sound pressure of suction sound generated in suction ducts according to Examples 1 and 2 and Comparative Example 1.

It is understood from FIG. 6 that the outlet sound is reduced on a large scale in the suction ducts according to Examples 1 and 2 in comparison with the background-art suction duct of Comparative Example 1. It is obvious that this is due to the effect that the suction ducts are formed by use of non-woven fabric molded bodies having predetermined permeability.

Figure 7:
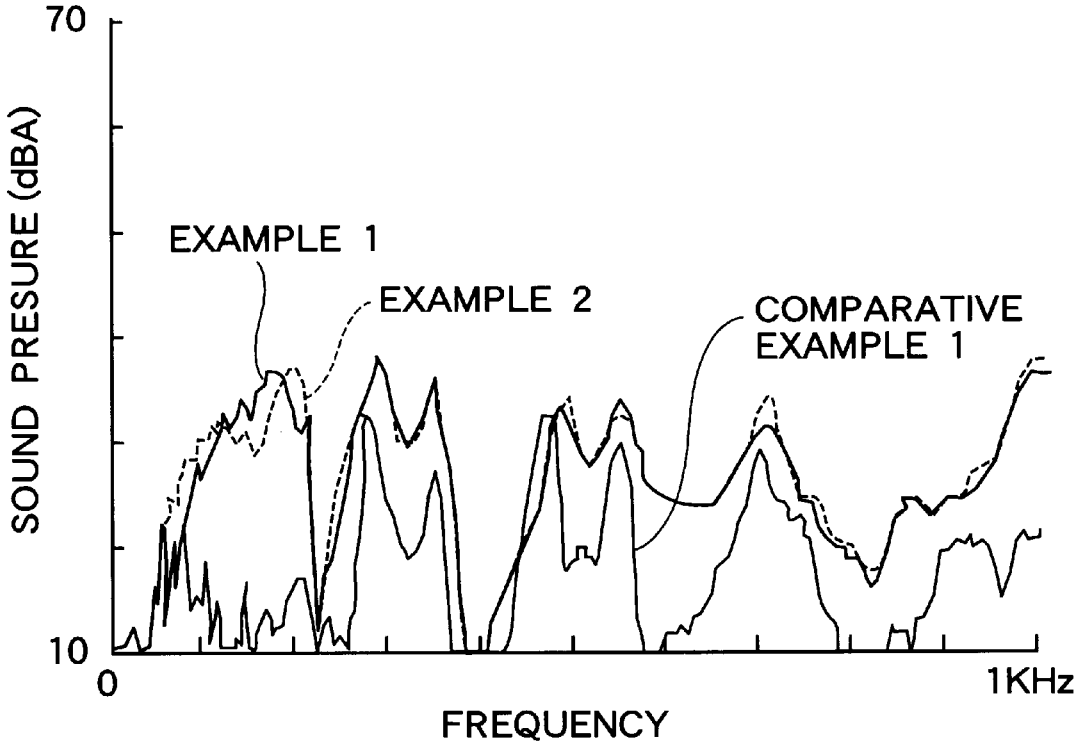
FIG. 7 is a graph showing the relationship between the frequency and the sound pressure of penetrating sound generated in the suction ducts according to Examples 1 and 2 and Comparative Example 1.

It is also understood from FIG. 7 that the penetrating sound increases in the suction ducts according to Examples 1 and 2 in comparison with that in Comparative Example 1.

Suction noise is constituted by both the outlet sound and the penetrating sound. Accordingly, if Examples 1 and 2 and Comparative Example 1 are evaluated from both FIGS. 6 and 7, it is understood that Comparative Example 1 in which the outlet sound is extremely large is the worst with respect to suction noise.

In addition, from FIG. 6, the suction duct according to Example 1 is lower in sound pressure level in a low frequency band than that according to Example 2 in which there is no permeability. It is therefore understood that it is preferable to make the permeability higher than zero with respect to the outlet sound.

EXAMPLE 3

There was prepared non-woven fabric (unit weight: 1,400 g/m$^2$, and thickness: 3 mm) containing 70 volume % of high-melting PET fibers having a melting point in a range of from 220° C. to 260° C. and 30 volume % of low-melting PET fibers having a melting point at 160° C. This non-woven fabric was disposed in a press molding mold, and hot-press-molded to be 3 mm thick while being heated to the melting point of the low-melting PET fibers. Thus, upper and lower members shaped into split halves of a suction duct, which had the same shape as that in FIG. 4 but had a non-divided structure, were formed in the same manner as Example 1.

Then, the upper and lower members were fitted to each other like a duct, and flange portions on opposite sides were bonded integrally with each other by ultrasonic welding. Thus, a suction duct (duct length: 700 mm, and inner diameter: 66 mm) according to Example 3 was obtained. The thicknesswise air permeability per 1 m$^2$ of the duct wall of this suction duct was 1,000 m$^3$/h when the pressure difference was 98 Pa.

In the obtained suction duct, there was a portion in which the curvature radius was small, but nevertheless the shape accuracy was superior and the production of a crack or the like was not found. In addition, an intermediate characteristic between characteristics of Examples 1 and 2 was obtained with respect to suction noise (outlet sound and penetrating sound).

EXAMPLE 4

Figure 8:
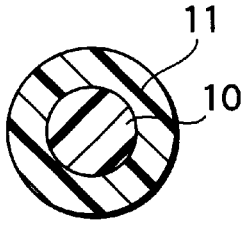
FIG. 8 is a sectional view of a PET fiber used in a suction duct according to Example 4.

A suction duct was manufactured in the same manner as Example 3 but by use of non-woven fabric wholly formed out of denier PET fibers each constituted by a core material 10 with a diameter of about 7 $\mu$m consisting of high-melting PET having a melting point in a range of from 220° C. to 260° C. and a coating layer 11 with a thickness of about 12 $\mu$m consisting of low-melting PET fibers having a melting point at 160° C. and covering the circumference of the core material 10, as shown in FIG. 8. The thicknesswise air permeability per 1 m$^2$ of the duct wall of this suction duct was 900 m$^3$/h when the pressure difference was 98 Pa. In addition, the volume of the coating layer 11 was about 18 times as large as the volume of the core material 10.

In the obtained suction duct, there was a portion in which the curvature radius was small, but nevertheless the shape accuracy was superior and the production of a crack or the like was not found. In addition, a characteristic substantially the same as that of Example 3 was exhibited with respect to suction noise.

Referential Example

Figure 9:
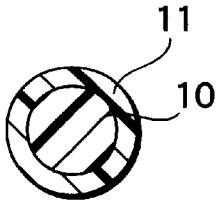
FIG. 9 is a sectional view of a PET fiber used in a suction duct according to Comparative Example 2.

A suction duct was manufactured in the same manner as Example 3 but by use of non-woven fabric wholly formed out of denier PET fibers each constituted by the same core material as that in Example 4 and a coating layer 11 with a thickness of about 4 $\mu$m consisting of low-melting PET having a melting point at 160° C. and covering the circumference of the core material 10, as shown in FIG. 9. The thicknesswise air permeability per 1 m$^2$ of the duct wall of this suction duct was 3,000 m$^3$/h when the pressure difference was 98 Pa. In addition, the volume of the coating layer 11 was about 3 times as large as the volume of the core material 10.

In the suction duct in this referential example, a crack was produced in the duct wall at a portion with a small curvature radius at the time of hot press molding, so that the suction duct leaked suction noise.

EXAMPLE 5

Figure 10:
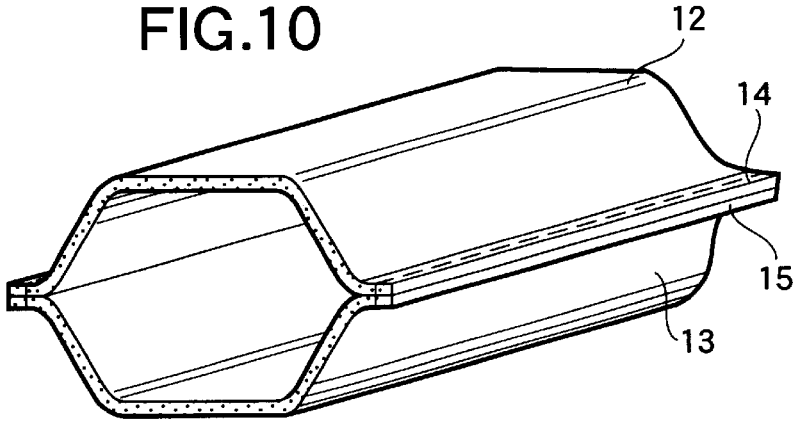
FIG. 10 is a main portion partially sectional perspective view showing a suction duct according to Example 5.

FIG. 10 shows a main portion perspective view of a suction duct according to Example 5 .This suction duct is similar to that in Example 3, except that flange portions 14 and 15 of upper and lower members 12 and 13 shaped into split halves respectively are bonded by sewing. Incidentally, they may be bonded not by sewing but by a stapler.

If such bonding by sewing or by a stapler is employed, no large-scale apparatus such as a welding machine becomes unnecessary so as to become most suitable for small quantity batch production.

EXAMPLE 6

Figure 11:
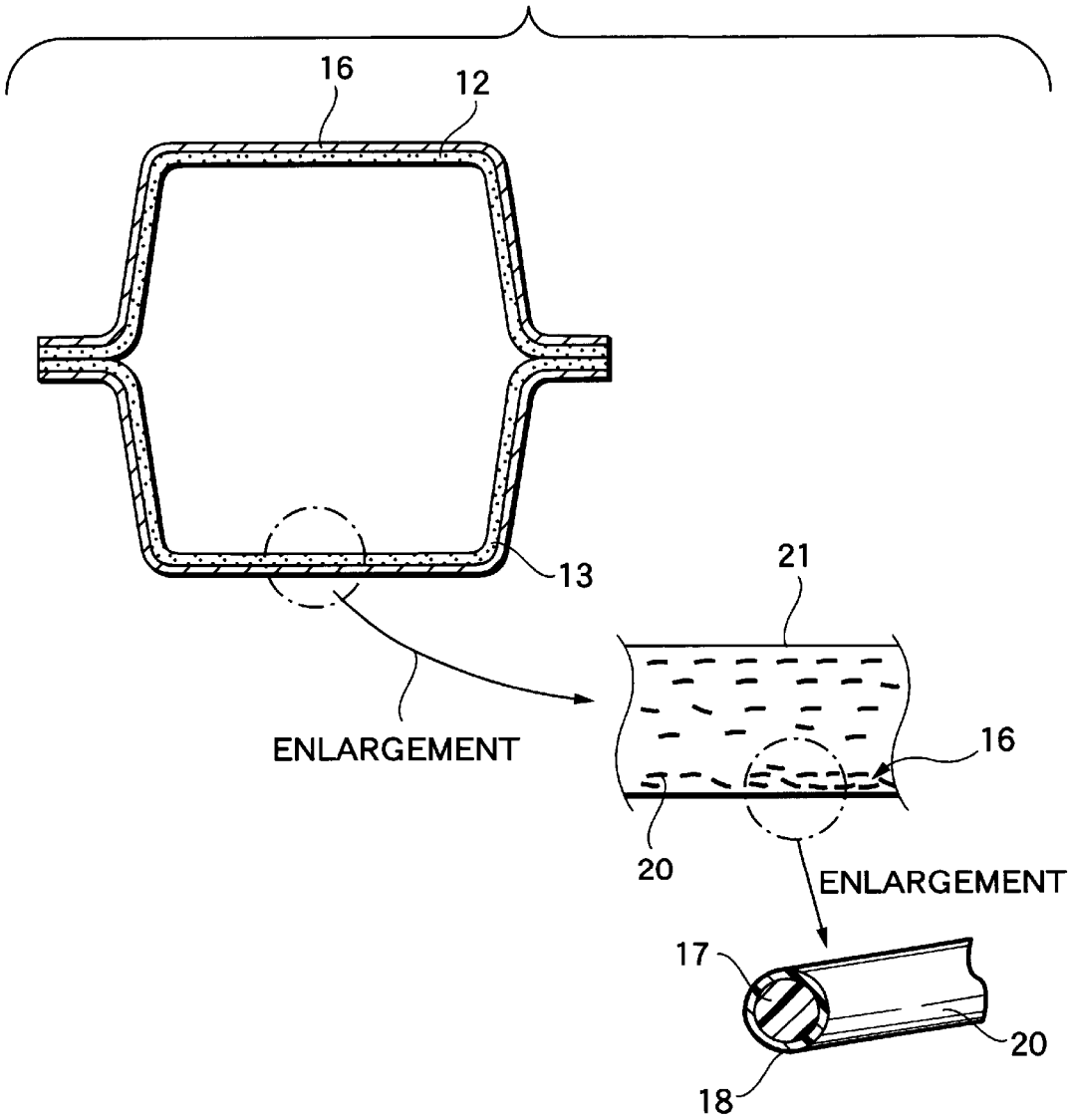
FIG. 11 is a sectional view of a suction duct according to Example 6, including main portion expanded views thereof.

FIG. 11 shows a sectional view of a suction duct according to Example 6. This suction duct is similar to that in Example 3, except that a water-repellent layer 16 is formed on the surface of each of upper and lower members 12 and 13 shaped into split halves.

This suction duct was manufactured in the same manner as Example 3 but by use of non-woven fabric 21 in which water-repellent fibers 20 each obtained by coating a PET fiber 17 with a silicon resin layer 18 were disposed in a surface layer.

According to this suction duct, moisture is restrained from invading the duct wall because the water-repellent layer 16 is formed on the surface. As a result, the thickness of the duct wall is restrained from changing due to the invasion of moisture, so that the balance between penetrating sound penetrating the molded body and suction sound radiated from an air suction inlet at a front end of the suction duct can be kept stable. In addition, water is restrained from invading an air cleaner apparatus.

Although it is most preferable to provide the water-repellent layer 16 in the outer circumferential surface of the suction duct, the position of the water-repellent layer 16 is not limited to this but the layer 16 may be located in any one of the positions in the outer circumferential surface, the inner circumferential surface and the intermediate layer, or may be provided in a plurality of positions. Further, non-woven fabric in which the water-repellent fibers 20 are dispersed uniformly may be used so as to form a water-repellent layer as a whole.

Although the water-repellent layer 16 is formed by using non-woven fabric containing the water-repellent fibers 20 in Example 6, a water-repellent layer may be formed by laminating a silicon resin film, a fluororesin film, or the like, on non-woven fabric. Also in this case, the water-repellent layer may be located in any position of the outer circumferential surface, the inner circumferential surface and the intermediate layer, or provided in a plurality of positions.

EXAMPLE 7

Although a suction duct according to the present invention restrains columnar resonance effectively, it is difficult to restrain noise in a low frequency band of from 80 Hz to 100 Hz caused by factors, other than columnar resonance, such as engine speed or the like. In order to restrain such noise, it is effective to make the suction duct have such a shape that the aperture diameter on the air inlet side of the suction duct is reduced and the diameter increases gradually toward an air-outlet side aperture. However, there is a case where it is necessary to reduce the air-inlet side aperture diameter extremely. In such a case, there is such a defect that the engine output is lowered in a high engine speed region where a large quantity of the air is required.

Figure 17:
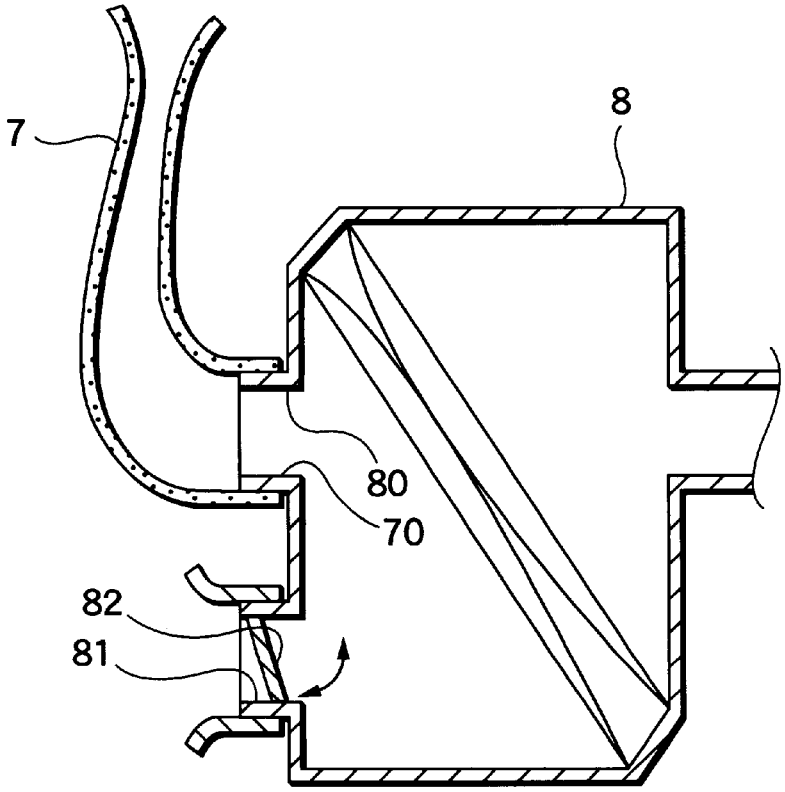
FIG. 17 is a sectional view showing a suction duct according to Example 7 together with an air cleaner.

In Example 7, therefore, as shown in FIG. 17, a suction duct 7 in which the diameter is small in an air-inlet side aperture but is expanded gradually from the air-inlet side aperture toward an air-outlet side aperture is formed in the same manner as Example 1. The outlet side aperture 70 is coupled with a first air inlet 80 of an air cleaner 8.

On the other hand, a second air inlet 81 which is larger in diameter than the first air inlet 80 is formed in the air cleaner 8. In addition, a valve 82 driven by a not-shown driving means is swingably provided in the second air inlet 81.

According to such a suction apparatus, the valve 82 is closed at a low engine speed, so that suction air is supplied from the suction duct 7 into the air cleaner 8. Then, suction noise in a middle/high frequency band is reduced by the characteristic of the suction duct 7 made of non-woven fabric. In addition, suction noise in a low frequency band is reduced by the shape of the suction duct 7 (reduced in the diameter of the air-inlet side aperture).

When the engine speed increases to a predetermined value, the valve 82 is driven by a not-shown driving means, so that the second air inlet 81 is opened. As a result, suction air flows into the air cleaner 8 from both the first air inlet 80 and the second air inlet 81, so that the air quantity required for high engine speed can be ensured.

EXAMPLE 8

Figure 18:
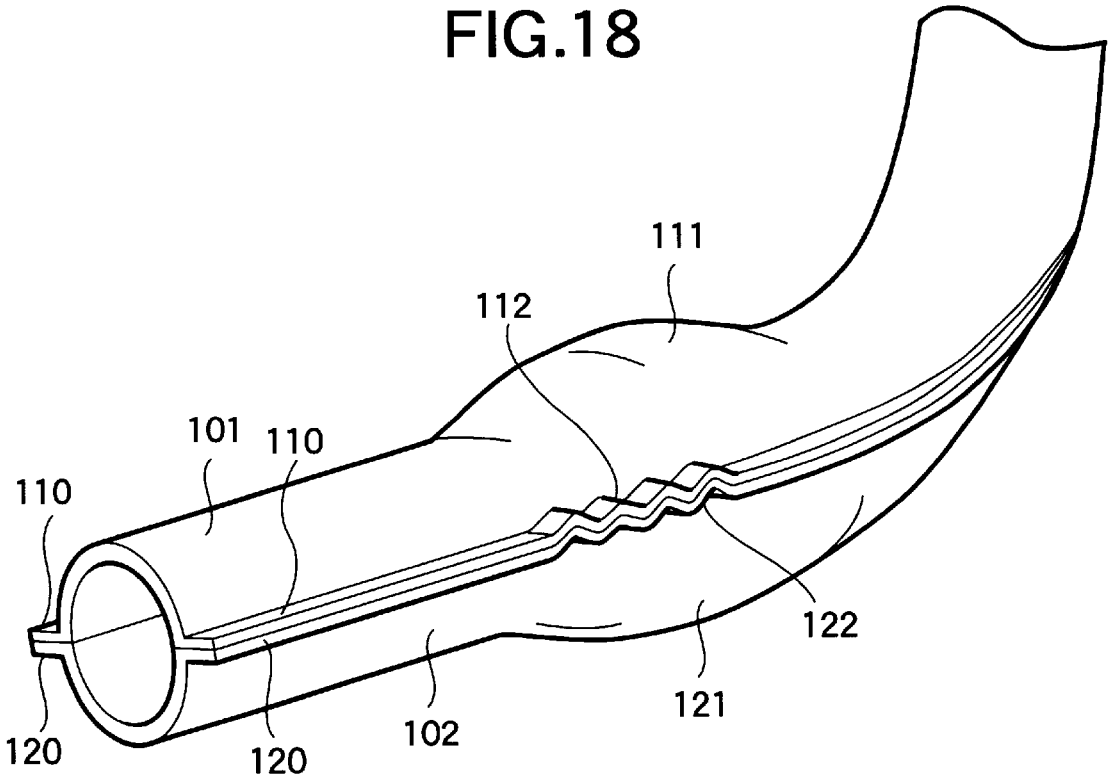
FIG. 18 is a perspective view of a suction duct according to Example 8 of the present invention.

FIG. 18 shows a perspective view of a suction duct according to Example 8. This suction duct is divided into split halves, that is, it is constituted by a first segment 101 and a second segment 102. The segments 101 and 102 have flange portions 110 and 120 on their opposite sides. The flange portions 110 and 120 facing each other are bonded integrally with each other. In addition, low-compressibility soft portions 111 and 121 bulging with respect to other portions are formed in parts of the first and second segments 101 and 102 respectively, while corrugated flexible portions 112 and 122 are formed in the flange portions 110 and 120 along the soft portions 111 and 121 respectively. The manufacturing method of this suction duct will be described below in place of the detailed description of its configuration.

First, a non-woven fabric sheet which was formed out of PET fibers and which was about 35 mm thick was prepared. In this non-woven fabric sheet, binder fibers consisting of low-melting PET fibers were contained by 30 volume %, and the unit weight was 1,400 g/m$^2$. Next, this non-woven fabric sheet was disposed in a press molding mold, and hot-press-molded to be 3 mm thick in an ordinary portion while being heated to a melting point of the binder fibers. Thus, the first and second segments 101 and 102 were formed.

At this time, the distance in a predetermined portion of the press molding mold is expanded more than other portions to form the soft portions 111 and 121 each having a thickness of 5 mm, while the mold surface of a predetermined portion is formed into a predetermined corrugated shape to form the flexible portions 112 and 122.

Next, the first and second segments 101 and 102 were fitted to each other so that the flange portions 110 and 120 faced each other. The flange portions 110 and 120 were bonded integrally with each other by ultrasonic welding. Thus, the suction duct (duct length: 700 mm, and inner diameter: 66 mm) according to Example 8 was obtained.

In this suction duct, the soft portions 111 and 121 are soft because their compressibility is smaller than that of any other portion. In addition, the soft portions 111 and 121 have the flexible portions 112 and 122 respectively. Accordingly, the flexibility is high in the portions where there are the soft portions 111 and 121 and the flexible portions 112 and 122. As a result, even if vibration is given to the suction duct in use, the portions where there are the soft portions 111 and 121 and the flexible portions 112 and 122 are deformed to absorb the vibration, so that the durability is high and noise is restrained from being generated. In addition, any portion other than the soft portions 111 and 121 plays a role as a hard portion with high compressibility.

EXAMPLE 9

Figure 19:
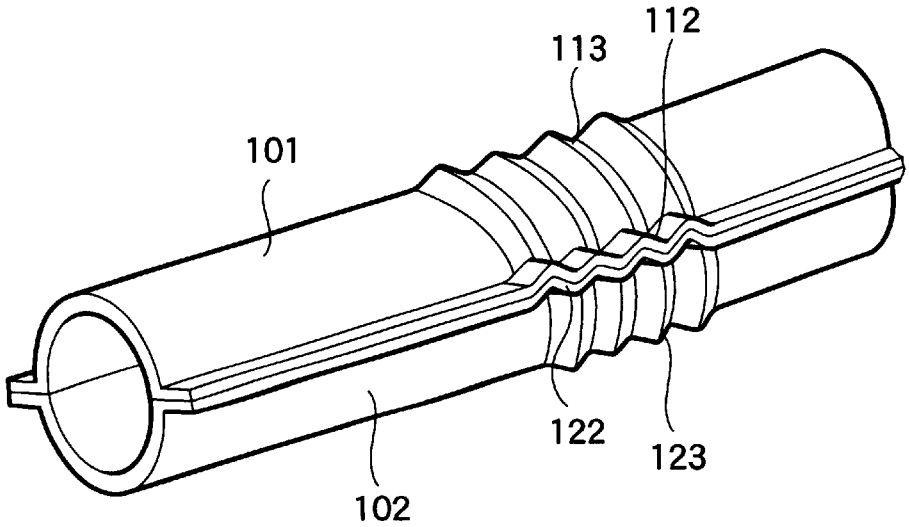
FIG. 19 is a perspective view of a suction duct according to Example 9 of the present invention.

A suction duct according to Example 9 shown in FIG. 19 has a configuration similar to that in Example 8, except that flexible portions 113 and 123 are further formed in place of the soft portions 111 and 121 and in the portions corresponding thereto respectively. In this suction duct, the flexible portions 113 and 123 acts in the same manner as the soft portions 111 and 121, so that there are obtained a similar operation and a similar effect to those in the suction duct according to Example 8.

EXAMPLE 10

Figure 20:
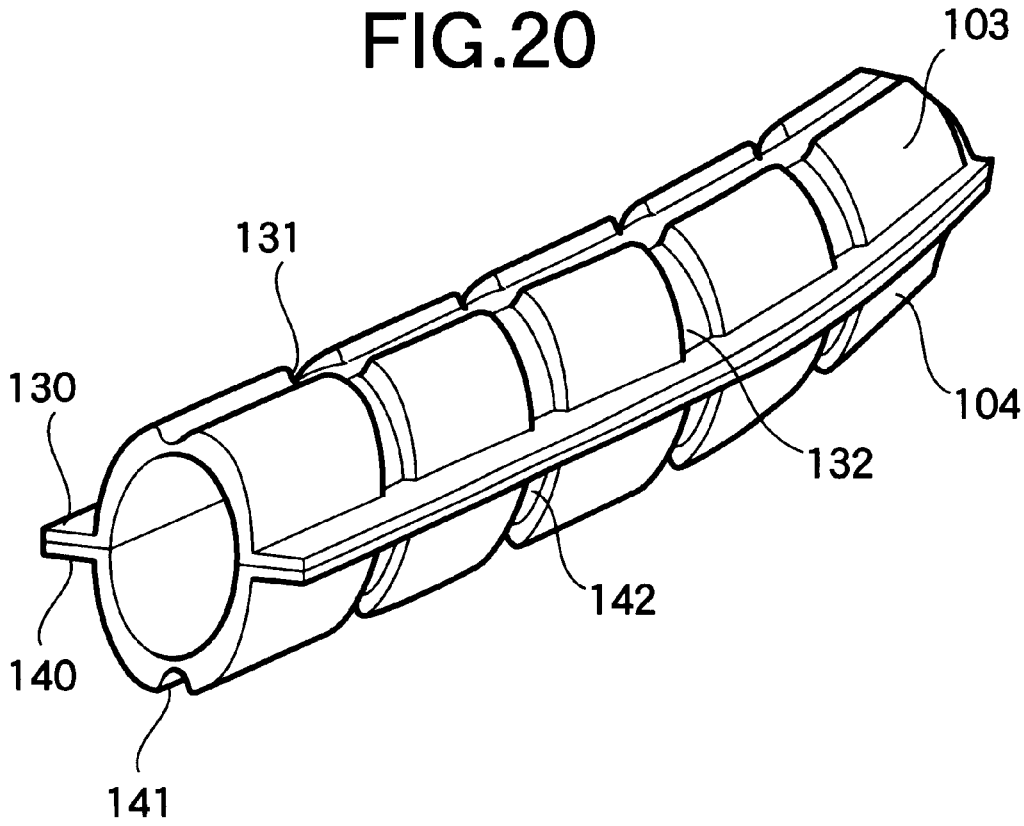
FIG. 20 is a perspective view of a suction duct according to Example 10 of the present invention.
Figure 21:
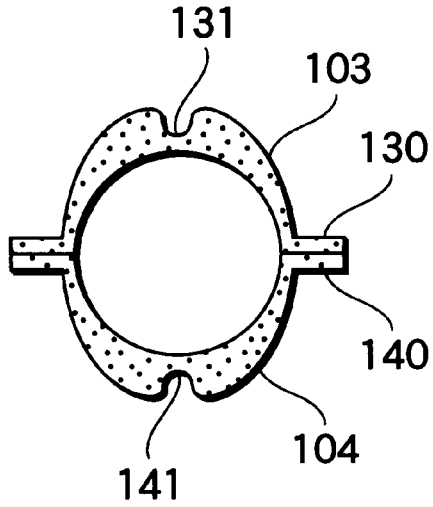
FIG. 21 is a sectional view of the suction duct according to Example 10 of the present invention.

A suction duct according to Example 10 shown in FIGS. 20 and 21 is formed by use of a non-woven fabric sheet similar to that in Example 8. This suction duct is constituted by a first segment 103 and a second segment 104, which are bonded with each other through their flange portions 130 and 140 respectively in the same manner as Example 8. Recess trunk portions 131 and 141 each 1.5 mm thick are formed in parallel to the flange portions 130 and 140 respectively, and branch portions 132 and 142 each 1.5 mm thick are further formed to extend perpendicularly to the trunk portions 131 and 141 and in the circumferential direction of the suction duct respectively. Any portion other than the trunk portions 131 and 141 and the branch portions 132 and 142 is formed to be 3 mm thick no less than any portion other than the soft portions 111 and 121 in Example 8. Thus, the trunk portions 131 and 141 and the branch portions 132 and 142 have high compressibility so as to be particularly hard. That is, each trunk portion plays a roll as a reinforcing portion extending in the axial/lengthwise direction of the suction duct, while each branch portion plays a roll as a reinforcing portion extending in the circumferential direction of the suction duct.

Thus, according to the suction duct in Example 10, the bending shape retentivity is superior due to the hard trunk portions 131 and 141 and the flange portions 130 and 140, so that the number of man-hour for installation is prevented from increasing due to the deformation of the suction duct. In addition, the inner diameter retentivity is excellent due to the hard branch portions 132 and 142, so that the suction duct is prevented from buckling even if excessive negative pressure or external force acts thereon. It is therefore possible to ensure a stable quantity of the air all the time.

EXAMPLE 11

Figure 22:
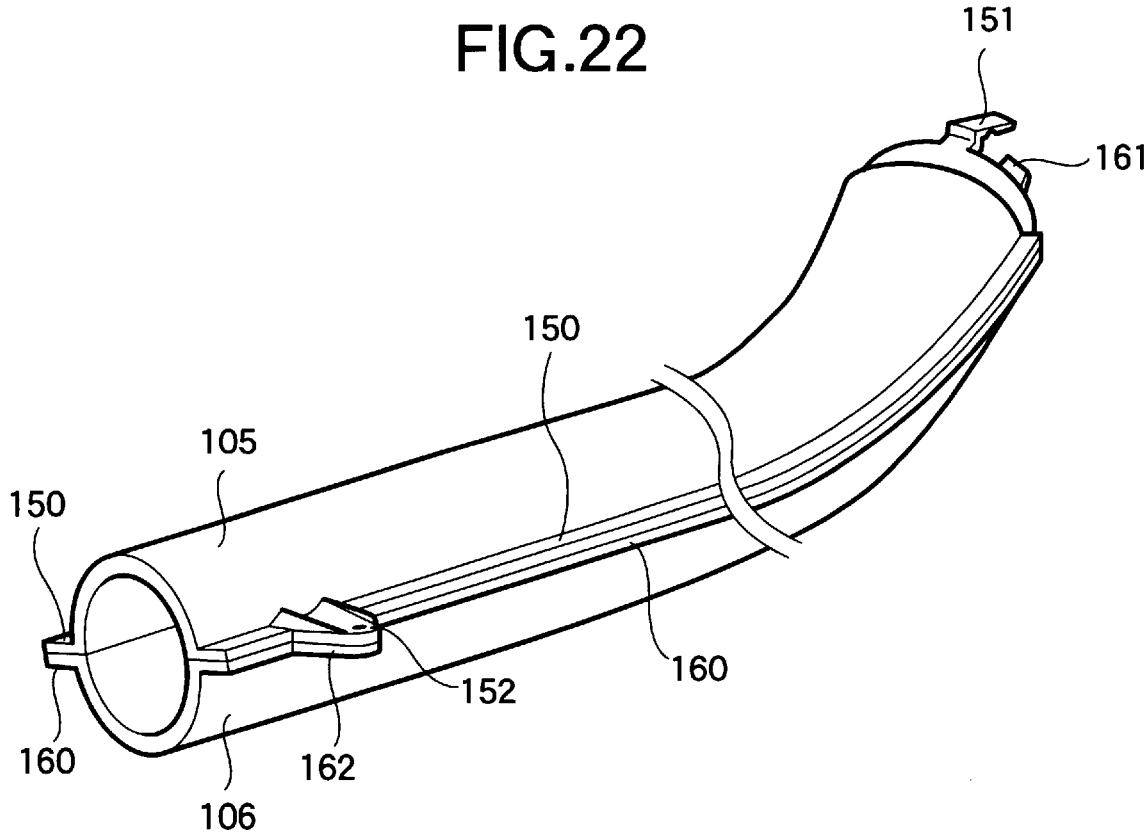
FIG. 22 is a perspective view of a suction duct according to Example 11 of the present invention.

A suction duct according to Example 11 shown in FIG. 22 is, formed by use of non-woven fabric similar to that in Example 8. This suction duct is constituted by a first segment 105 and a second segment 106, which are bonded with each other through their flange portions 150 and 160 respectively in the same manner as Example 8. Hard engagement claws 151 and 161 are formed in end portions of the first and second segments 105 and 106 respectively, while protrusion portions 152 and 162 are formed on the flange portions 150 and 160 in the other end portions respectively. The protrusion portions 152 and 162 are laminated on each other integrally, so as to function as brackets for attaching the suction duct to a partner member.

Figure 23:
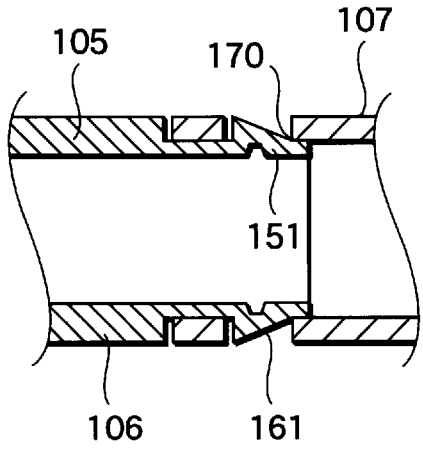
FIG. 23 is a main portion sectional view showing the suction duct according to Example 11 of the present invention, in which the suction duct has been attached to a partner member.

The engagement claws 151 and 161 have sectional shapes shown in FIG. 23 respectively, and are configured to engage with an engagement hole 170 of a partner member 107. In addition, the engagement claws 151 and 161 are 1.5 mm thick so as to be high in compressibility and hard in comparison with the ordinary portion which is 3 mm thick. Thus, the engagement claws 151 and 161 engage with the engagement hole 170 by means of their elastic deformation and then recover their original shapes so that they are prevented from being detached from the partner member-after engagement.

Incidentally, the engagement claws 151 and 161 are first formed integrally with the first and second segments 105 and 106 as semicircular cylindrical portions in their sectional shapes respectively, and further formed to have predetermined widths by cutting the first and second segments 105 and 106 respectively.

Figure 24:
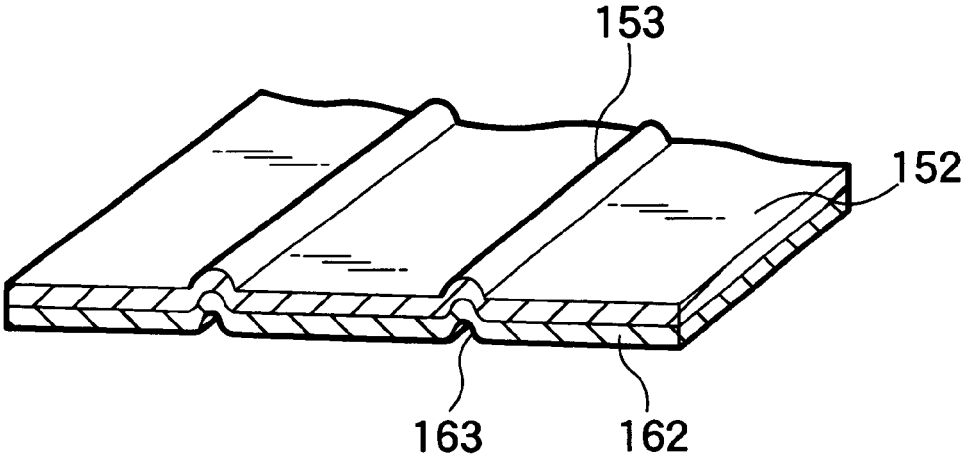
FIG. 24 is a perspective view showing another aspect of the suction duct according to Example 11 of the present invention, in which protrusion portions are partially illustrated by sectional view.

In addition, the protrusion portions 152 and 162 are made 1.5 mm thick respectively so as to have higher compressibility than that in the ordinary portion, which is 3 mm thick. Thus, sufficient strength is ensured. Incidentally, it is also preferable that ribs 153 and 163 are formed on the surfaces of the protrusion portions 152 and 162 respectively as shown in FIG. 24. As a result, the protrusion portions 152 and 162 are further enhanced in strength so that further sufficient strength is ensured as brackets.

It is therefore possible to attach the suction duct according to Example 11 to a partner member without necessity of other parts because the suction duct has engagement portions and brackets for the partner member, so that the cost is reduced. In addition, the suction duct is also superior in recyclability.

EXAMPLE 12

Figure 12:
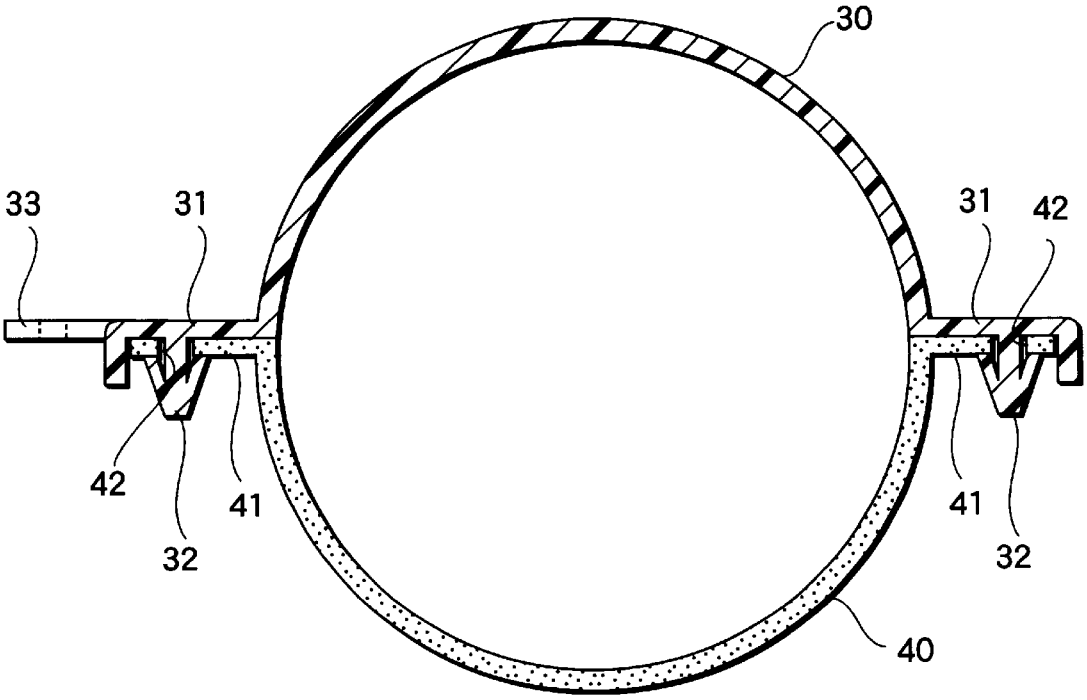
FIG. 12 is a sectional view of a suction duct according to Example 12.

FIG. 12 shows a sectional view of a suction duct according a to Example 12. This suction duct is constituted by a first segment 30 and a second segment 40.

The first segment 30 is formed out of polypropylene by injection molding so that flange portions 31 are formed on its opposite, left and right sides. In each of these flange portions 31, a plurality of engagement protrusions 32 are arrayed integrally with the flange portion 31 at regular intervals. In addition, a bracket 33 is formed integrally with a part of the flange portion 31.

The second segment 40 is formed out of non-woven fabric made of PET fibers by hot press molding in the same manner as Example 1, and flange portions 41 are formed on its opposite, left and right sides. In addition, in each of these flange portions 41, a plurality of through holes 42 are arrayed at regular intervals. These through holes 42 are formed at the same time in a process in which unnecessary portions around the flange portions 41 are punched out after the second segment 40 is molded.

In the suction duct according to Example 12, the engagement protrusions 32 engage with the through holes 42 respectively so that the first and second segments 30 and 40 are coupled integrally with each other. Thus, since the rigidity of the first segment 30 is large in this suction duct, the suction duct can be coupled with a partner member through the brackets 33 without necessity of other parts such as attachment brackets or the like. In addition, the rigidity of the engagement protrusions 32 is so large that sufficient coupling strength can be ensured. In addition, since the second segment 40 is made of non-woven fabric, it has slight permeability. As a result, an intermediate characteristic between characteristics in Examples 1 and 2 was obtained with respect to suction noise (outlet sound and penetrating sound) in the suction duct according to Example 12.

Figure 13:
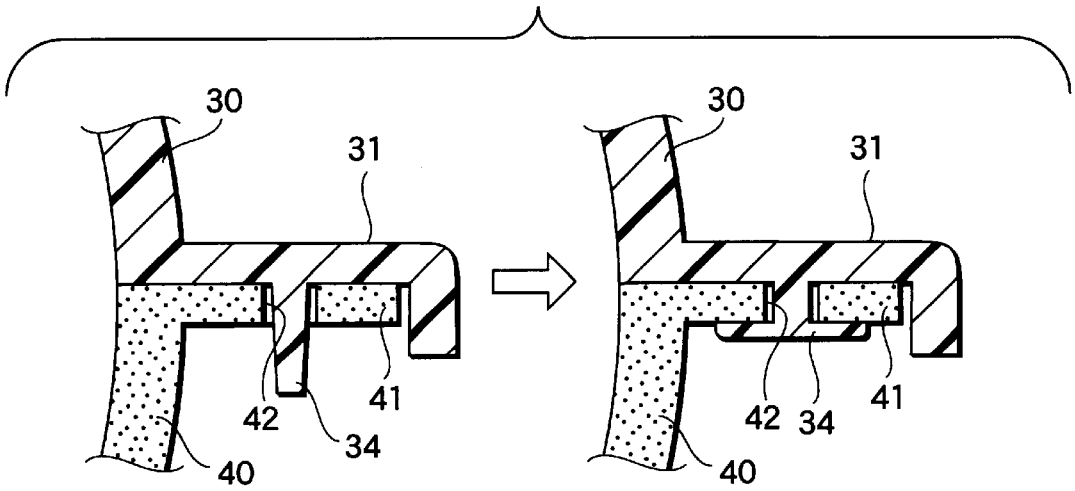
FIG. 13 is a main portion sectional view showing another aspect of the suction duct according to Example 12.

Although mechanical coupling means based on the engagement protrusions 32 and the through holes 42 was used for coupling the first and second segments 30 and 40 with each other in Example 12, hot caulking may be used, in which a protrusion 34 projecting from the flange portion 31 of the first segment 30 is inserted into a through hole 42, and then a head of the protrusion 34 is melted and engaged with the flange portion 41 as shown in FIG. 13.

Figure 14:
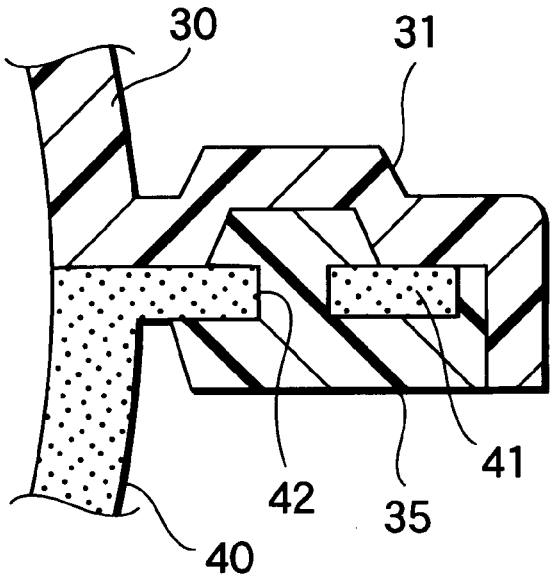
FIG. 14 is a main portion sectional view showing a further aspect of the suction duct according to Example 12.

Alternatively, as shown in FIG. 14, the second segment 40 is disposed in a mold, and an engagement portion 35 penetrating the through hole 42 and coupled integrally with the second segment 40 is formed by injection molding. After that, the first segment 30 is put on the second segment 40 and welded with the engagement portion 35 by vibration welding so that the first and second segments 30 and 40 can be integrated with each other through the engagement portion 35.

Alternatively, though not illustrated, if through holes communicating with each other are formed in both the flange portions 31 and 41 when the first and second segments 30 and 40 are integrated with each other, the integration can be attained by inserting a clip or the like into the through holes.

Figure 15:
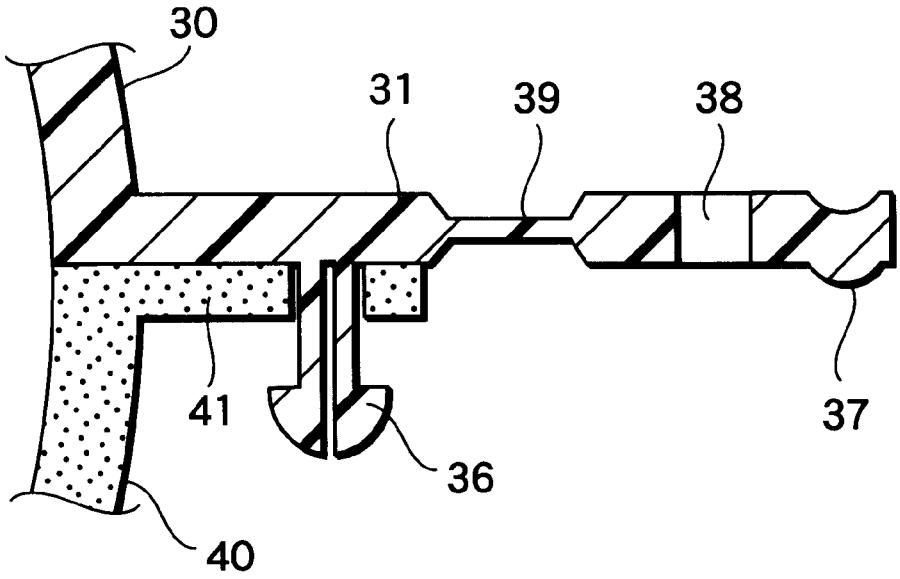
FIG. 15 is a main portion sectional view showing a further aspect of the suction duct according to Example 12, in which a first segment and a second segment have not been coupled with each other yet.
Figure 16:
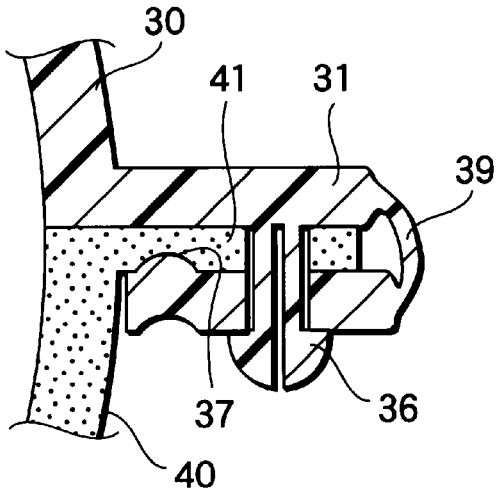
FIG. 16 is a main portion sectional view showing a further aspect of the suction duct according to Example 12.

Further, it is also preferable that a coupling structure is adopted as shown in FIG. 16. In this coupling structure, a plurality of flexible pin bosses 36 projecting over the flange portion 31 of the first segment 30 and shaped into split halves, are formed at intervals as shown in FIG. 15. In addition, a protrusion strip 37 and an engagement hole 38 are formed in a front end portion of the flange portion 31. In addition, a hinge portion 39 is formed between the pin boss 36 and the engagement hole 38. After the pin boss 36 is inserted into the through hole 42, the front end of the flange portion 31 is bent outward by 180° at the hinge portion 39 so that the engagement hole 38 is engaged with the pin boss 36. As a result, the flange portion 41 of the second segment 40 is held from its opposite sides by the flange portion 31 of the first segment 30, so that the first and second segments 30 and 40 are integrated with each other.

According to this coupling structure, the protrusion strip 37 serves to press the flange portion 41 onto the flange portion 31 so that the tightness of coupling is enhanced, and further the flange portion 31 can cover fully the end surfaces of the flange portion 41 of the second segment 40. It is therefore possible to surely prevent water from invading the suction duct through a boundary between the first and second segments 30 and 40.

In the case where a part of a suction duct is formed out of a non-woven fabric molded body as in Example 12, it is preferable that the ratio of the area occupied by the non-woven fabric molded body to the whole of the suction duct is made not less than ¼ of the suction duct length and not less than ¼ of the suction duct circumferential length. In addition, the area occupied by the non-woven fabric may be provided in a plurality of portions. In that case, it will go well if the suction duct is constituted by a first segment and a plurality of second segments, and the sum of the respective areas occupied by the plurality of second segments satisfies the above-mentioned conditions in the longitudinal and circumferential directions of the duct.

Industrial Utilization

In the suction duct according to the present invention, it is possible to reduce suction noise at a low engine speed with a simple and low-priced configuration. In addition, since no throttle or the like is used, it is possible to supply an enough quantity of the air at a high engine speed.

Further, when the whole of the suction duct is formed out of non-woven fabric by hot press molding, the suction duct can be manufactured at a single molding process even if the duct has a complicated three-dimensional shape. As a result, the suction duct becomes high in outer diameter size accuracy, low in price and light in weight. Moreover, the inner circumferential surface can be shaped by a mold. As a result, the degree of surface roughness of the inner circumferential surface can be made so fine that there is no defect that the air permeation resistance increases.

In addition, the rigidity can be freely adjusted by changing the positions or sizes of soft and hard portions, so that the suction duct can be provided to have a characteristic in accordance with purposes.

Moreover, the rigidity can be freely adjusted by changing the positions or sizes of flexible portions, so that the suction duct can be provided to have a characteristic in accordance with purposes.

What is claimed is:

1. A suction duct to be disposed between an outside air intake of a motorcar and an intake manifold of an engine, wherein said suction duct has a duct wall, and at least a part of said duct wall is formed out of a molded body of non-woven fabric having permeability, wherein the permeability per $1m^2$ of said molded body is not larger than $6{,}000m^3/h$ in case of air with a pressure difference of 98 Pa.

2. A suction duct according to claim 1, wherein permeability per 1 $m^2$ of said molded body is not larger than 6,000 $m^3/h$ in case of air with pressure difference 98 Pa.

3. A suction duct according to claim 2, wherein said permeability per 1 $m^2$ of said molded body is smaller than 4,200 $m^3/h$ in case of air with a pressure difference of 98 Pa.

4. A suction duct according to claim 3, wherein said permeability per 1 $m^2$ of said molded body is larger than 0 $m^3/h$ and smaller than 3,000 $m^3/h$ in case of air with a pressure difference of 98 Pa.

5. A suction duct according to claim 1, wherein said non-woven fabric contains thermoplastic resin fibers.

6. A suction duct according to claim 1, wherein all of said duct wall is formed out of said molded body.

7. A suction duct according to claim 1, wherein all of said duct wall is formed out of said molded body, and wherein said non-woven fabric contains high-melting fibers of high-melting thermoplastic resin and low-melting fibers of low-melting thermoplastic resin having a lower melting point than that of said high-melting fibers, and a ratio of said low-melting fibers to said non-woven fabric is higher than that of said high-melting fabric.

8. A suction duct according to claim 7, wherein a volume ratio of said low-melting fibers to said non-woven fabric is in a range of from 20% to 50%.

9. A suction duct according to claim 7, wherein a melting point of said low-melting fibers is in a range of from 150° C. to 170° C., and a melting point of said high-melting fibers is in a range of from 220° C. to 260° C.

10. A suction duct according to claim 1, wherein all of said duct wall is formed out of said molded body, and wherein said non-woven fabric contains thermoplastic fibers constituted by a core material of high-melting thermoplastic resin and a coating layer applied onto a surface of said core material and of a low-melting thermoplastic resin having a lower melting point than that of said core material, and a volume of said coating layer is larger than that of said core material.

11. A suction duct according to claim 10, wherein a melting point of said low-melting fibers is in a range of from 150° C. to 170° C., and a melting point of said high-melting fibers is in a range of from 220° C. to 260° C.

12. A suction duct according to claim 1, wherein said molded body is formed out of non-woven fabric having a functional layer to which a predetermined function is given.

13. A suction duct according to claim 12, wherein said functional layer is a water-repellent layer.

14. A suction duct according to claim 12, wherein said functional layer is a clogging preventing layer.

15. A suction duct to be disposed between an outside air intake of a motorcar and an intake manifold of an engine, said suction duct comprising:

a first segment constituted by a molded body of synthetic resin; and a second segment constituted by a molded body of non-woven fabric, the non-woven fabric having permeability, wherein said first and second segments are coupled integrally with each other so as to be formed into a cylinder.

16. A suction duct according to claim 15, wherein said first segment has an engagement protrusion, wherein said second segment has a through hole, and wherein said engagement protrusion is engaged with said through hole so that said first and second segments are coupled integrally with each other.

17. A suction duct according to claim 15, wherein said first segment has a protrusion, wherein said second segment has a through hole, and wherein said protrusion is inserted into said through hole, and then a head of said protrusion is melted so that said protrusion is made to engage with said through hole, and said first and second segments are coupled integrally with each other.

18. A suction duct according to claim 15, wherein said second segment has a through hole, an engagement portion made of resin is provided to penetrate said through hole, and said engagement portion and said first segment are welded with each other so that said first and second segments are coupled integrally with each other.

19. A suction duct according to claim 15, wherein said first segment has a pin boss having flexibility, a hinge portion, an engagement hole and a protrusion strip which are formed outside said hinge portion, wherein said second segment has a through hole, and wherein said pin boss is passed through said through hole, and said hinge portion is bent so that said pin boss is engaged with said engagement hole, whereby said protrusion strip presses said second segment onto said first segment so that said first and second segments are coupled integrally with each other.

20. A suction duct disposed between an outside air intake of a motorcar and an intake manifold of an engine, said suction duct comprising a hard portion with high compressibility and a soft portion with low compressibility, which portions are formed out of non-woven fabric containing a thermoplastic resin binder by compression molding, the non-woven fabric having permeability.

21. A suction duct according to claim 20, wherein said non-woven fabric contains thermoplastic resin fibers.

22. A suction duct according to claim 20, wherein said hard portion extends linearly.

23. A suction duct according to claim 22, wherein said hard portion is formed in a direction substantially perpendicular to a direction in which said suction duct extends.

24. A suction duct according to claim 22, wherein said hard portion is formed in a direction in which said suction duct extends.

25. A suction duct according to claim 20, wherein an engagement portion which can engage with a partner member is formed in said hard portion.

26. A suction duct according to claim 25, wherein only the compressibility of said engagement portion is further higher.

27. A suction duct to be disposed between an outside air intake of a motorcar and an intake manifold of an engine, said suction duct comprising a plurality of segments, each of said segments being formed out of non-woven fabric, the non-woven fabric having permeability and containing a thermoplastic resin binder by compression molding so as to have a substantially semicircular sectional shape with flange portions on its opposite sides, said flange portions of said segments being bonded with each other so that said segments are formed into a cylinder, a deformable flexible portion being provided in at least a part of said flange portions.

28. A suction duct according to claim 27, wherein said flexible portion is formed into a corrugated shape in which mountain portions and valley portions are alternated continuously.

29. A suction duct according to claim 27, wherein a flexible portion is provided in a portion other than said flange portions.

* * * * *